US010822206B2

(12) United States Patent
Manchester

(10) Patent No.: US 10,822,206 B2
(45) Date of Patent: Nov. 3, 2020

(54) LOAD CONTROL APPARATUS AND METHOD FOR CONTROLLING MOVEMENT OF A SUSPENDED LOAD

(71) Applicant: IHC Engineering Business Limited, Stocksfield, Northumberland (GB)

(72) Inventor: Jonathan Ralph Manchester, Stocksfield (GB)

(73) Assignee: IHC Engineering Business Limited, Northumberland (GB)

( * ) Notice: Subject to any disclaimer, the term of this patent is extended or adjusted under 35 U.S.C. 154(b) by 0 days.

(21) Appl. No.: 15/747,344

(22) PCT Filed: Jul. 27, 2016

(86) PCT No.: PCT/GB2016/052304
§ 371 (c)(1),
(2) Date: Jan. 24, 2018

(87) PCT Pub. No.: WO2017/017450
PCT Pub. Date: Feb. 2, 2017

(65) Prior Publication Data

US 2018/0222727 A1 Aug. 9, 2018

(30) Foreign Application Priority Data

Jul. 30, 2015 (GB) ..... 1513483.6

(51) Int. Cl.
*B66C 13/06* (2006.01)
*B66C 13/08* (2006.01)

(52) U.S. Cl.
CPC ..... *B66C 13/063* (2013.01); *B66C 13/06* (2013.01); *B66C 13/08* (2013.01); *B66C 13/085* (2013.01)

(58) Field of Classification Search
CPC ..... B66C 13/063; B66C 13/085; B66C 3/005; B66C 13/006
(Continued)

(56) References Cited

U.S. PATENT DOCUMENTS 3,210,114 A * 10/1965 Lawton ..... B66C 13/08 294/81.4
3,719,296 A * 3/1973 Larson, Jr. ..... B65D 90/623 414/422
(Continued)

FOREIGN PATENT DOCUMENTS

CN 101357738 A 2/2009
CN 102358559 A 2/2012
(Continued)

OTHER PUBLICATIONS

GB Search Report under Section 17(5) issued in counterpart GB Application No. 1513483.6 dated Dec. 17, 2015, (five (5) pages).
(Continued)

*Primary Examiner* — Paul T Chin
(74) *Attorney, Agent, or Firm* — E. Eric Mills; Nexsen Pruet, PLLC

(57) ABSTRACT

A load control apparatus and method for controlling movement of a suspended load is disclosed. The load control apparatus includes: a base for attachment to or forming part of a load; a support element pivotally secured to and extending from the base for receiving and/or connecting to a lift line; and actuation means connected to the support element and to the base at respective positions which are spaced from the pivotal connection between the support element and the base such that actuation, in use, of the actuation means causes the base to pivot relative to the support element.

13 Claims, 6 Drawing Sheets

(58) Field of Classification Search
USPC ..... 294/67.5, 67.32, 86.41; 414/735; 212/239; 901/21
See application file for complete search history.

(56) References Cited

U.S. PATENT DOCUMENTS

| | | | | | |
|---|---|---|---|---|---|
| 3,799,358 | A * | 3/1974 | Putnam | B66C 13/08 | 212/285 |
| 4,154,470 | A * | 5/1979 | Dalglish | B66C 1/54 | 294/86.41 |
| 4,273,242 | A * | 6/1981 | Schaper | B66C 13/06 | 212/273 |
| 4,358,143 | A * | 11/1982 | Cullen | B21C 47/242 | 242/533 |
| 4,666,362 | A * | 5/1987 | Landsberger | B25J 9/0078 | 212/239 |
| 4,687,244 | A * | 8/1987 | Cullen | B65H 67/065 | 294/86.41 |
| 4,739,241 | A * | 4/1988 | Vachtsevanos | B25J 17/0266 | 310/166 |
| 4,854,800 | A | 8/1989 | Frick et al. | | |
| 4,883,184 | A * | 11/1989 | Albus | B66C 13/06 | 212/274 |
| 5,094,495 | A * | 3/1992 | Littell | B66C 1/0212 | 294/65 |
| 5,154,561 | A | 10/1992 | Lee | | |
| 5,388,935 | A * | 2/1995 | Sheldon | B23Q 1/5462 | 248/631 |
| 5,617,964 | A | 4/1997 | Lucking et al. | | |
| 5,740,699 | A * | 4/1998 | Ballantyne | B25J 17/0266 | 403/120 |
| 5,865,491 | A * | 2/1999 | Lee | B66C 13/08 | 294/67.5 |
| 5,871,249 | A * | 2/1999 | Williams | B66C 13/08 | 294/81.4 |
| 6,220,807 | B1 * | 4/2001 | Sorokan | E21B 19/155 | 414/22.62 |
| 6,477,912 | B2 * | 11/2002 | Song | B23Q 1/5462 | 414/735 |
| 7,150,366 | B1 | 12/2006 | Zakula, Sr. et al. | | |
| 7,172,385 | B2 * | 2/2007 | Khajepour | B25J 17/0266 | 414/735 |
| 7,207,610 | B1 * | 4/2007 | Kauppila | B66C 1/585 | 294/106 |
| 8,127,871 | B2 * | 3/2012 | Viola | B62D 57/032 | 180/8.5 |
| 8,174,369 | B2 * | 5/2012 | Jones | G06K 7/0008 | 340/10.1 |
| 8,532,252 | B2 * | 9/2013 | Nakamura | G21K 1/06 | 378/145 |
| 9,073,732 | B2 * | 7/2015 | LaValley | B66C 1/44 | |
| 9,545,697 | B2 * | 1/2017 | Whinnem | B23Q 1/5462 | |
| 9,694,455 | B2 * | 7/2017 | Brown | B25J 9/0045 | |
| 9,764,482 | B2 * | 9/2017 | Ilch | B25J 17/0266 | |
| 10,406,678 | B2 * | 9/2019 | Westermeier | B25J 9/0051 | |
| 2001/0019692 | A1 * | 9/2001 | Ehrat | B25J 15/0616 | 414/735 |
| 2011/0100145 | A1 * | 5/2011 | Feng | B25J 17/0266 | 74/490.01 |
| 2012/0118097 | A1 * | 5/2012 | Ilch | B25J 17/0266 | 74/490.05 |
| 2012/0308354 | A1 * | 12/2012 | Tafazoli Bilandi | E02F 9/264 | 414/685 |
| 2015/0360372 | A1 * | 12/2015 | Schiettecatte | B25J 9/0015 | 294/197 |

FOREIGN PATENT DOCUMENTS

| | | | |
|---|---|---|---|
| CN | 202131003 | U | 2/2012 |
| GB | 1150695 | A | 4/1969 |
| GB | 2355705 | A1 | 5/2001 |
| GB | 2380182 | A | 4/2003 |
| GB | 2467149 | A | 7/2010 |
| JP | S53-002257 | B | 1/1978 |
| JP | S6194995 | A | 5/1986 |
| JP | S63-167498 | U | 11/1988 |
| JP | H01275398 | A | 11/1989 |
| WO | 2014175824 | A1 | 10/2014 |

OTHER PUBLICATIONS

Brazilian Search Report issued in counterpart Brazilian Application No. BR112018002024-9 dated Feb. 4, 2020.

* cited by examiner

LOAD CONTROL APPARATUS AND METHOD FOR CONTROLLING MOVEMENT OF A SUSPENDED LOAD

CROSS REFERENCE TO RELATED APPLICATIONS

This application is a 35 U.S.C. § 371 U.S. national phase entry of International Application No. PCT/GB2016/052304 having an international filing date of Jul. 27, 2016, which claims the benefit of Great Britain Application No. 1513483.6 filed Jul. 30, 2015, each of which is incorporated herein by reference in its entirety.

The present invention relates to an apparatus for controlling movement of a suspended load. More specifically, although not exclusively, the present invention relates to an apparatus for reducing or eliminating oscillating movement of a suspended load, particularly in a load suspended by a crane.

BACKGROUND

Cranes and other lifting apparatus are commonly required for moving loads from one position to another. In the offshore industry cranes are often used to transport loads between vessels and the shore or from vessel to vessel or from vessel to the sea, for example.

When transporting a load via a crane or other lifting apparatus, problems can occur if a suspended load begins to oscillate in a pendulum type motion. Oscillations of the crane load can be induced by several factors. Movement of the crane tip itself can cause oscillations due to the initial velocity difference between the crane tip and the suspended load. Also, for cranes located on an offshore platform or a ship, wave motion of the platform or ship can cause a suspended load to oscillate. It is also possible for wind acting on the tip of the crane or the load itself to cause oscillations of the suspended load. In some situations, pendulum action can also become resonant with increasing energy.

Oscillating loads can be difficult to control and often a crane operator may have to simply wait for oscillations to naturally reduce before the load can be safely landed in its desired position. Alternatively the lifting operation may have to be delayed to fall into a prescribed sea state condition. This is usually a very time consuming and therefore costly process. Also a swaying load can be a health and safety concern in some environments.

For cranes positioned on a floating platform (e.g. a ship), continuous wave motions can further add to the problem of reducing motion of an oscillating load. Without the ability to sufficiently steady a load, it can be very difficult to land the load in the correct place with the required precision.

One known system described in GB2380182 is a load handling device that has a retractable stabilizer that is movable between a retracted position and an extended position. In the retracted position the load can move freely with respect to the device and in the extended position the stabilizer contacts the load to limit or control pivoting movement of the load.

Another known system described in GB2336355 includes a stabilising frame that is extendable over a lifting cable. The stabilizing frame extends over or adjacent to the lifting cable during lifting to maintain the centre of gravity of the stabilizing system along the same vertical axis with respect to the lifting cable. This helps to control the movement of the load because during the lift there is no significant lateral force acting on the load as a result of the centre of gravity of the stabilizing system being displaced to one side.

Other load handling systems are described in GB1150695, U.S. Pat. No. 4,883,184, GB2355705 and U.S. Pat. No. 7,150,366.

Whilst some known apparatus control the sway (pendulum effect) of a load to a certain degree, there is a particular problem when the load is acted upon by external factors such as wave motion and wind (as mentioned above). These problems are even more prominent when operating cranes offshore during rough seas.

Many of the above arrangements include dampeners/dampers. A damper is a passive device that takes out energy. In the case of a viscous damper the damping force is related to velocity.

The invention aims to provide an apparatus that addresses one or more of the above problems. The invention also aims to provide a load control apparatus that can actively respond to movement of a load and mitigate the effects of pendulum-like motion caused by more extreme environments. The invention also aims to provide a load control apparatus that can be used with existing lifting devices without affecting the certification (maximum operating load) of the lifting device. The invention also aims to provide a load control apparatus that can respond to movement of a suspended load and apply a force to oppose the movement of the suspended load.

BRIEF SUMMARY OF THE DISCLOSURE

In accordance with a first aspect of the present invention, there is provided a load control apparatus for controlling movement of a suspended load, the apparatus comprising: a base for attachment to or forming part of a load; a support element pivotally connected and/or gimbaled and/or secured to and extending from the base for receiving and/or connecting to a lift line; and an actuation means connected to the support element and to the base at respective positions which are spaced from the pivotal connection such that actuation, in use, of the actuation means causes the base to pivot relative to the support element.

Thus, the invention provides an apparatus that may be configured to provide active control of the movement of a suspended load, for example by actively countering an oscillatory motion thereof.

The support element may comprise a connection means for connection to the lift line. The apparatus may be configured such that the weight of the load is transmitted to the lift line via the base and support element, for example whereby the apparatus may comprise or provide a lifting frame for connection with a lifting apparatus. This enables the apparatus to form part of the load, which does not affect the certification of the lifting device. Alternatively, the lift line may be connected to the base or to the load directly, in which case the support element may receive the lift line, e.g. a portion of the lift line, which may extend therethrough to the connection with the base or load.

The support element may comprise an elongate member, column or beam. The support element may be pivotally connected and/or gimbaled and/or secured to a central portion of the base, for example at or adjacent one of its ends, e.g. a first end. The support element may comprise the connection means at or adjacent one of its ends, for example another of its ends or a second end. Alternatively, the support element or column or beam may be configured to receive, in use, a portion of a lift line that is connected to the base or to the load. For example, the support element may comprise a tubular column through which the lift line may extend and connect to the base or to the load.

The actuation means may be connected to the support element between the first and second ends or at or adjacent the second end. The actuation means may be connected to an outer or peripheral portion of the base.

In embodiments, the apparatus or actuation means comprises an actuator, e.g. one or two or more actuators. At least one or each actuator may be connected to the support element between the first and second ends or at or adjacent the second end. Additionally or alternatively, at least one or each actuator may be connected to different outer or peripheral portions of the base. The apparatus may be configured such that actuation, in use, of each of two or more actuators causes the base to pivot in a different direction and/or about a different axis relative to the column. The actuators or at least two of the actuators may extend at an angle with respect to each other from the support element. Aptly, they extend at a right or substantially right angle, e.g. orthogonally, with respect to each other from the support element. Alternatively, they may extend at an oblique angle, such as an acute or obtuse or reflex or oblique angle, with respect to each other from the support element. In embodiments, the actuators or at least two of the actuators extend radially from the support element in respective directions that extend at such an angle with respect to one another.

As used herein, the term actuator or actuation is used for a component that acts to move another member. I.e. an actuator actively applies a force to displace a member.

The pivotal connection or securement between the support element and the base may allow the support element to pivot about two or more axes relative to the base. Additionally or alternatively, the pivotal connection or securement between the base and the support element may comprises a universal joint or a gimbal unit.

The apparatus may comprise a control means 1000, which may be operable to control the actuation of the actuation means or at least one or each actuator, for example in response to movement of the suspended load. The control means may comprise an algorithm that is configured to detect or anticipate an oscillatory motion of the load and, for example, control actuation of the actuation means or of one or at least one or each actuator in response thereto and/or to prevent or inhibit such oscillatory motion. The control means may comprise a control system or one or more controllers or a module of such a system or one or a combination of such controllers.

The apparatus may comprises sensing means, which may be operatively connected to the control means. The sensing means may be configured to sense relative movement or motion between any two or more of the base, the support element, a landing platform and/or a lifting apparatus to which the load control apparatus is connected in use. The apparatus or sensing means may be operable or configured to transmit motion data or a sensed relative movement to the control means. The sensing means may comprise one or more sensors associated with, e.g. mounted or secured to, at least one or each or any combination of the base, the support element, a landing platform and/or a lifting apparatus. The skilled person would appreciate that several sensor combinations may be used to detect or anticipate an oscillatory motion of the load.

The base may comprise a central portion, for example to which the support element may be pivotally connected and/or secured. The base may comprise an outer or peripheral portion, for example to which the actuation means or at least one or each actuator may be connected. The central portion is aptly secured or connected to or integral with the outer or peripheral portion, for example by one or more, aptly two or more, more aptly at least three, radial elements or spokes. In embodiments, the base is planar and/or comprises a plate, for example a base plate. It will be appreciated that when the base comprises a plate, the plate may comprise any suitable thickness, but need only comprise a thickness and/or configuration, e.g. box-section or a frame assembly, that is appropriate for the loads involved. It will also be appreciated that where the base forms part of the load, that is to say the support element and actuation means are connected directly to the load, the portion of the load that forms the base may comprise a wall of a container or housing or a portion of a solid element or member, for example a concrete block or the like.

In embodiments, the actuation means, for example at least one or each actuator, is pivotally connected to one or each of the support element and/or the base. The base may comprise one or more pivotal connections or connectors, for example one or more pairs of upstanding brackets that may each include a hole, e.g. an opposed hole, for receiving a pin to engage an end of an actuator. Similarly, the support element may comprise one or more pivotal connections or connectors, for example one or more upstanding brackets that may each include a hole, e.g. an opposed hole, for receiving a pin to engage an end of an actuator.

The actuation means, for example at least one or each actuator, may comprise a hydraulic or pneumatic or electromechanical actuator. At least one or each actuator may comprise a cylinder and/or a piston, which may be movable within and/or along the cylinder. At least one or each actuator may comprise a rod, which may be connected to the piston, e.g. at an end which may be a first end thereof, and/or which rod may extend from an end of the cylinder, e.g. a first and/or open end of the cylinder. At least one or each actuator may comprise a pivotal connection or connector at one or each of its ends. The or each cylinder may comprise a pivotal connection or connector at an end thereof, e.g. a second and/or closed end. The or each rod may comprise a pivotal connection or connector at an end which may be a second end thereof.

Alternatively, the activation means may comprise a motor, or the like, supplying torque to the support element via a piston, rod, chain, or the like.

At least one of the pivotal connection or connector may comprise a bush or bearing with a hole or shaft or pin therethrough.

The support element may comprise one or more lifting holes for receiving a lifting element attached to a lifting line or for receiving a portion of the lift line. The base may comprise one or more attachment features for attaching the base to the load.

The apparatus may comprise a compass or compass heading, e.g. for determining orientation of the apparatus with respect to a landing platform.

According to a second aspect of the present invention there is provided a method of controlling movement of a load, for example using the apparatus as described above. The method may comprise applying via the actuation means a pivoting force between the support element and the base to oppose or inhibit a movement of the suspended load and/or to prevent or inhibit a detected or anticipated oscillatory motion or movement.

A further aspect of the invention provides a computer program element comprising computer readable program code means for causing a processor to execute a procedure to implement the aforementioned method. A yet further aspect of the invention provides the computer program element embodied on a computer readable medium.

A yet further aspect of the invention provides a computer readable medium having a program stored thereon, where the program is arranged to make a computer execute a procedure to implement the aforementioned method.

A yet further aspect of the invention provides a control means or control system or controller comprising the aforementioned computer program element or computer readable medium.

For purposes of this disclosure, and notwithstanding the above, it is to be understood that any controller(s), control units and/or control modules described herein may each comprise a control unit or computational device having one or more electronic processors. The controller may comprise a single control unit or electronic controller or alternatively different functions of the control of the system or apparatus may be embodied in, or hosted in, different control units or controllers or control modules. As used herein, the terms "control unit" and "controller" will be understood to include both a single control unit or controller and a plurality of control units or controllers collectively operating to provide the required control functionality. A set of instructions could be provided which, when executed, cause said controller(s) or control unit(s) or control module(s) to implement the control techniques described herein (including the method (s) described herein). The set of instructions may be embedded in one or more electronic processors, or alternatively, may be provided as software to be executed by one or more electronic processor(s). For example, a first controller may be implemented in software run on one or more electronic processors, and one or more other controllers may also be implemented in software run on or more electronic processors, optionally the same one or more processors as the first controller. It will be appreciated, however, that other arrangements are also useful, and therefore, the present invention is not intended to be limited to any particular arrangement. In any event, the set of instructions described herein may be embedded in a computer-readable storage medium (e.g., a non-transitory storage medium) that may comprise any mechanism for storing information in a form readable by a machine or electronic processors/computational device, including, without limitation: a magnetic storage medium (e.g., floppy diskette); optical storage medium (e.g., CD-ROM); magneto optical storage medium; read only memory (ROM); random access memory (RAM); erasable programmable memory (e.g., EPROM ad EEPROM); flash memory; or electrical or other types of medium for storing such information/instructions.

For the avoidance of doubt, any of the features described herein apply equally to any aspect of the invention. For example, the apparatus may comprise any one or more features of the method relevant thereto and vice versa.

Another aspect of the invention provides a computer program element comprising and/or describing and/or defining a three-dimensional design for use with a three-dimensional printing means or printer or additive manufacturing means or device, the three-dimensional design comprising one or more components of an embodiment of the apparatus described above.

Within the scope of this application it is expressly intended that the various aspects, embodiments, examples and alternatives set out in the preceding paragraphs, in the claims and/or in the following description and drawings, and in particular the individual features thereof, may be taken independently or in any combination. That is, all embodiments and/or features of any embodiment can be combined in any way and/or combination, unless such features are incompatible. For the avoidance of doubt, the terms "may", "and/or", "e.g.", "for example" and any similar term as used herein should be interpreted as non-limiting such that any feature so-described need not be present. Indeed, any combination of optional features is expressly envisaged without departing from the scope of the invention, whether or not these are expressly claimed. The applicant reserves the right to change any originally filed claim or file any new claim accordingly, including the right to amend any originally filed claim to depend from and/or incorporate any feature of any other claim although not originally claimed in that manner.

BRIEF DESCRIPTION OF THE DRAWINGS

Embodiments will now be described by way of example only with reference to the accompanying drawings in which.

DETAILED DESCRIPTION

Figure 1:
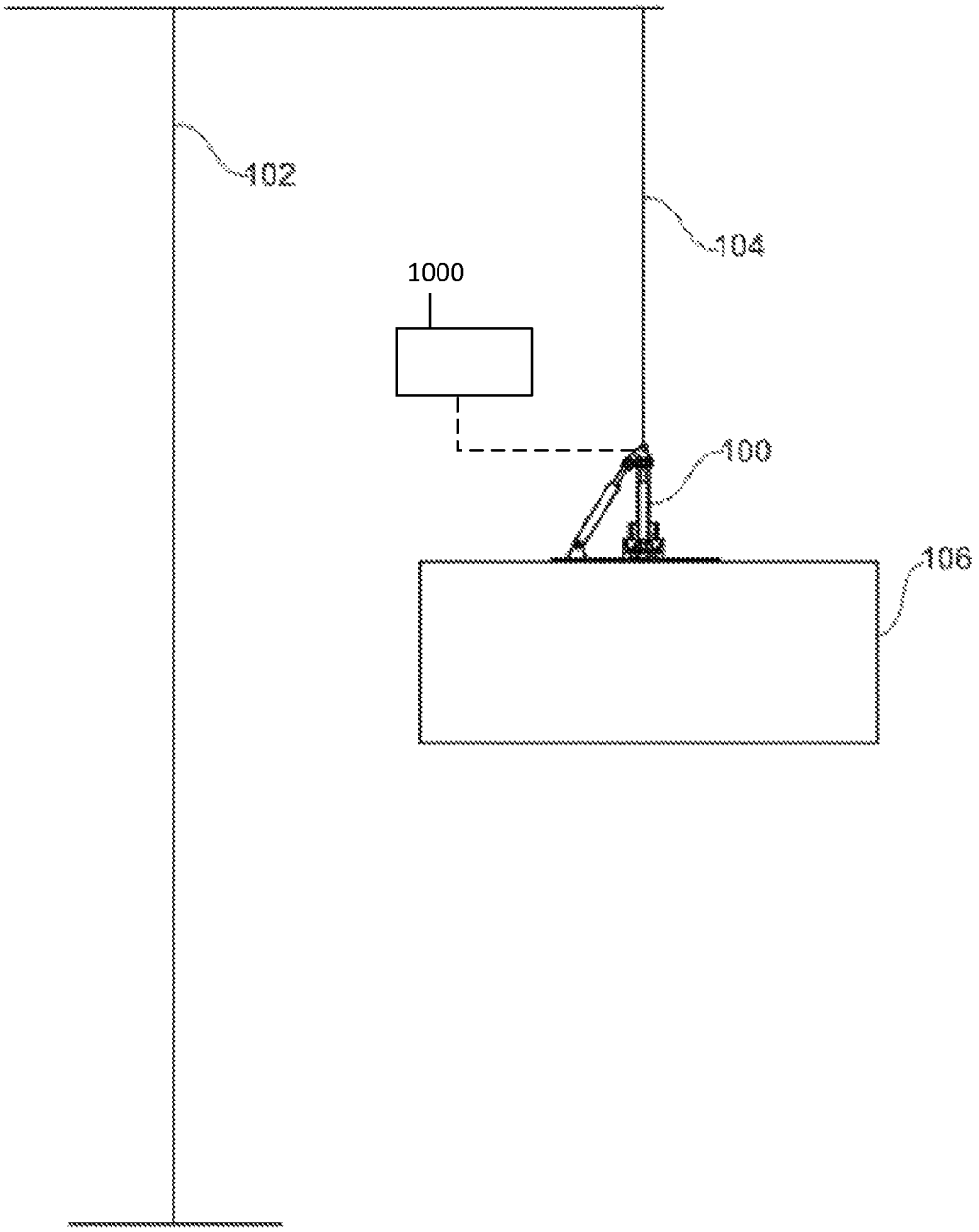
FIG. 1 shows a load control apparatus according to one embodiment, when positioned on a crane.
Figure 2:
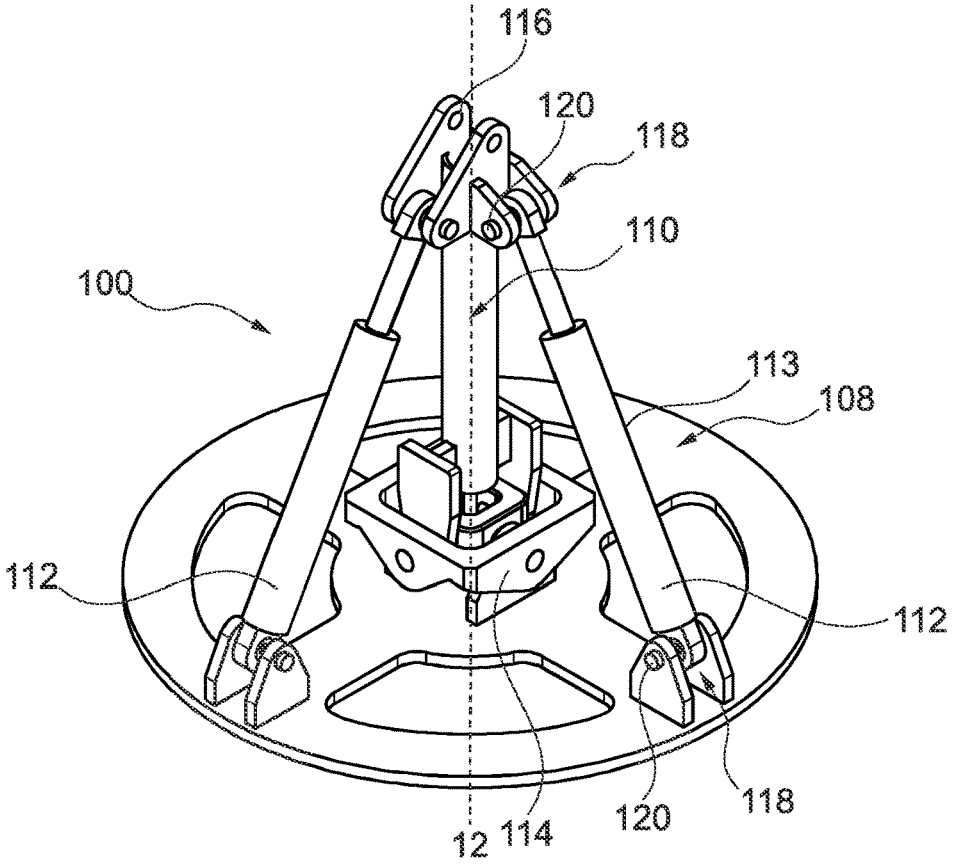
FIG. 2 is a close up perspective view of the load control apparatus of FIG. 1, when in a neutral position.
Figure 3:
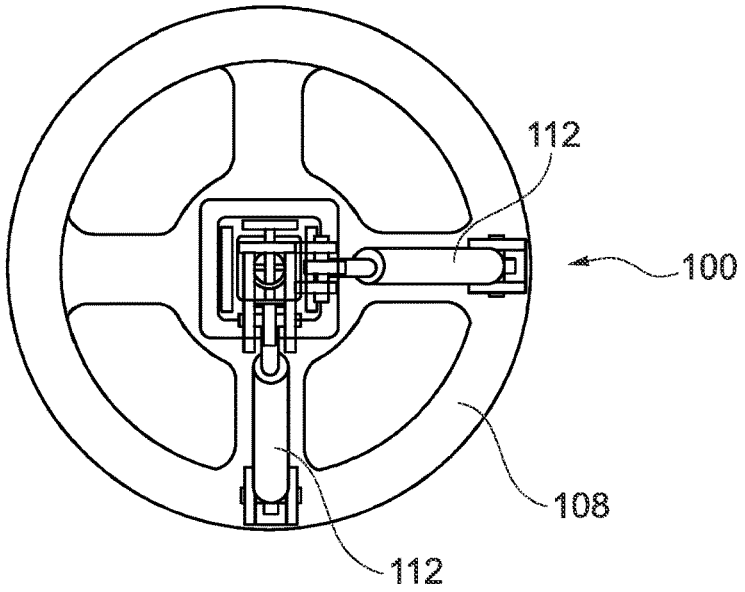
FIG. 3 is a plan view of the load control apparatus of FIG. 2.
Figure 4:
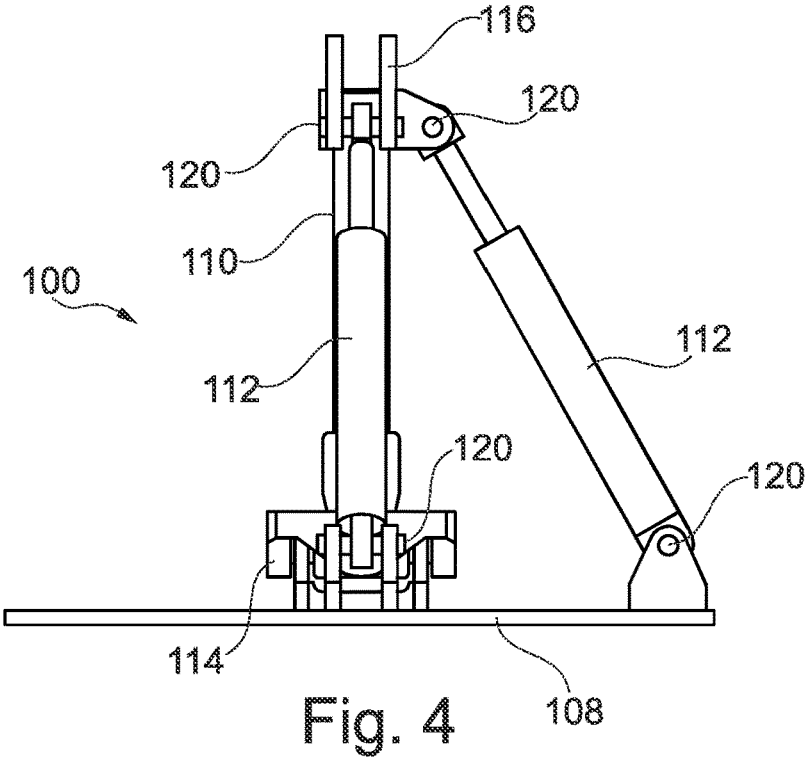
FIGS. 4 and 5 are side elevation views of the load control apparatus of FIGS. 2 and 3.
Figure 5:
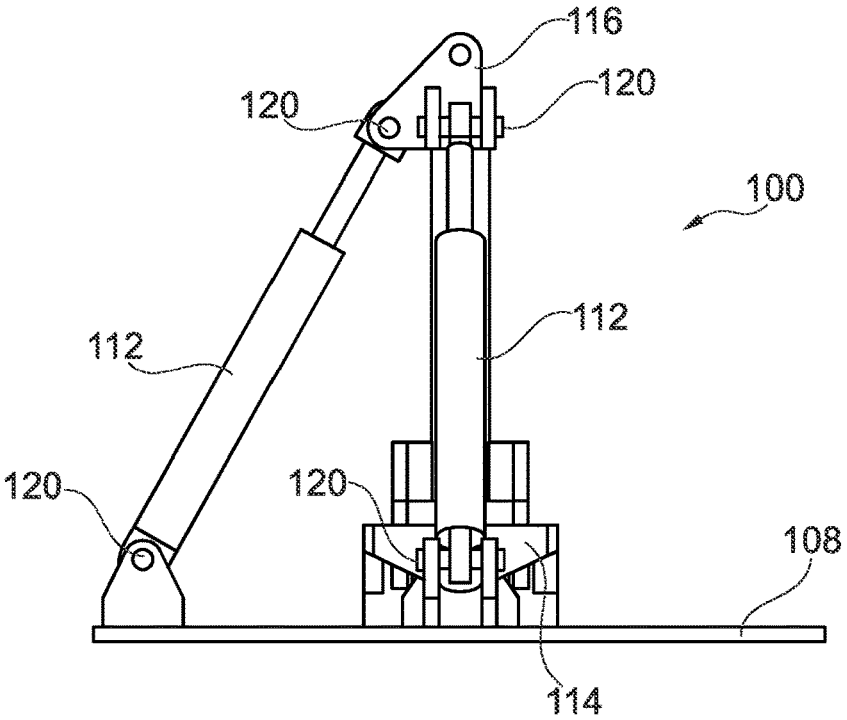

Referring now to the drawings, FIG. 1 shows a load control apparatus 100 in use with a crane assembly 102. Here the load control apparatus is shown in use with a tower crane (or balance crane) system. It will be appreciated that the load control apparatus may be also used with many other types of crane or lifting apparatus (e.g. telescopic cranes, truck mounted cranes, overhead cranes, A-frames).

The lift control apparatus 100 attaches to a lift line 104 of the crane assembly 102 (e.g. via a hook at the end of the lift line). A lift load 106 attaches to the lift control apparatus 100 and is suspended therefrom.

FIGS. 2 to 5 show one example of the lift control apparatus 100 in more detail.

The lift control apparatus 100 includes a base 108 to which a load 106 can be connected. Aptly, the load 106 is connected to the base 108 with a bottom surface of the base 108 contacting a surface of the load 106. Upon connection, the bottom surface of the base 108 is aptly flush with a surface of the load 106, as shown in FIG. 1. In this way, any forces applied to the base 108 can be transmitted directly to the load.

In this example, the base 108 includes a substantially circular plate with a circular central portion and a ring-shaped peripheral portion connected to the central portion by four radial spokes. The base 108 is formed from steel, though other suitable materials may include aluminium, chrome and/or nickel based alloys, titanium composite materials, or carbon-fibre based materials, or any other suitable materials, for example. Aptly the base is unstiffened, namely the base should be stiff enough to transmit forces induced by the actuators to the load without significant flexing of the base that could cause excessive wear on the apparatus.

A support element 110, e.g. a column or beam, is pivotally secured to and extends from the base 108. In this example, the support element 110 is in the form of a substantially cylindrical column and is formed from steel, though other materials may also be used. For example, the support element may be formed from aluminium, chrome and/or nickel based alloys, titanium composite materials, or carbon-fibre based materials, or any other suitable materials. The support element is shown at a substantially perpendicular angle to the base.

A first, lower end of the support element 110 is pivotally secured to the centre of the base 108. A second, upper end of the support element 110 includes a connection means in the form of a pair of upstanding brackets 116 with through holes (or lifting holes) into which a lift line 104 or lift hook can be inserted and connected. The lift control apparatus 100 is thus configured such that the weight of the load 106 is transmitted to the lift line 104 via the base 108 and support element 110.

In this embodiment, the support element 110 is connected to the base 108 by a connection that allows inclination of the support element 110 with respect to the base 108 in all planes passing through a central axis Z orthogonal to the base 108. That is, the support element 110 can pivot about its first end with respect to the base 108 in all directions, but no rotation of the support element with respect to the base is possible. In this way, the pivotal connection allows the support element 110 to pivot about two or more axes relative to the base 108.

In this example, the pivotal connection is in the form of a gimbal unit 114 with two axes of rotation to allow inclination of the support element 110 with respect to the base 108 in all planes passing through a central axis Z orthogonal to the base 108. Of course, other universal joints or couplings or a series of couplings may provide the pivotal connection.

Each of a pair of actuators 112 is connected to the support element 110 and to the base 108 at respective locations, which are spaced from the gimbal unit 114. In this example, the actuators 112 are hydraulic rams each including a cylinder and a piston rod. Aptly the hydraulic rams 112 are positioned with the cylinder at the end closest to the base 108. This has the advantage that the weight can be better distributed over the apparatus with the centre of gravity closer to the base.

Each actuator 112 connects the upper end of the support element 110 to a different (outer) position of the base 108. In this way, in use, actuation of each actuator causes the base 108 to pivot in a different direction and/or about a different axis relative to the column. In this example two actuators 112 extend from the upper end of the support element 110 to the base 108 in radial directions that are orthogonal with respect to each other, as can be seen most clearly in FIG. 3.

The actuators 112 are pivotally connected to each of the base 108 and support element 110 via pivoting joints 118 to allow inclination of the actuator 112 with respect to the base 108 and the support element 110. Each pivoting joint 118 includes a pair of spaced brackets with opposed holes that each receive a pin 120 which engages a hole, bushing or bearing of the actuator 112. It will be appreciated that the hole, bushing or bearing of the actuator 112 should be configured to allow at least some inclination of the base with respect to the support element in all directions (see, for example, FIG. 9). Alternatively, the actuator 112 can be connected at one or both ends via a universal joint, which would allow the support element 110 to pivot more freely in all directions with respect to the base 108.

A control unit or control means can be mounted onto the apparatus for controlling the actuators in response to movement of the load. The control unit can include one or more sensors for sensing movement of the load. A power supply unit can be mounted onto the apparatus and supplies power to the control unit and/or pressurised hydraulic fluid to the actuators 112. Alternatively, the control unit and/or the power supply may be mounted on the lifting device or on the ground or deck of a vessel on which the lifting apparatus is located, for example. In some embodiments, the actuators 112 may be electromechanically driven, for example such that a single electrical power supply may be used to power both the control unit and the actuators. In some embodiments the load may be a powered load capable of supplying power to the control unit and actuators. As such, when using a powered load an additional power supply unit may not be required.

In use, a lift load 106 can be attached to the base 108 via one or more attachment features. The attachment features may include one or more fasteners, such as bolts, and/or any one or more of hooks, frames, shackles and/or lines.

Figure 6:
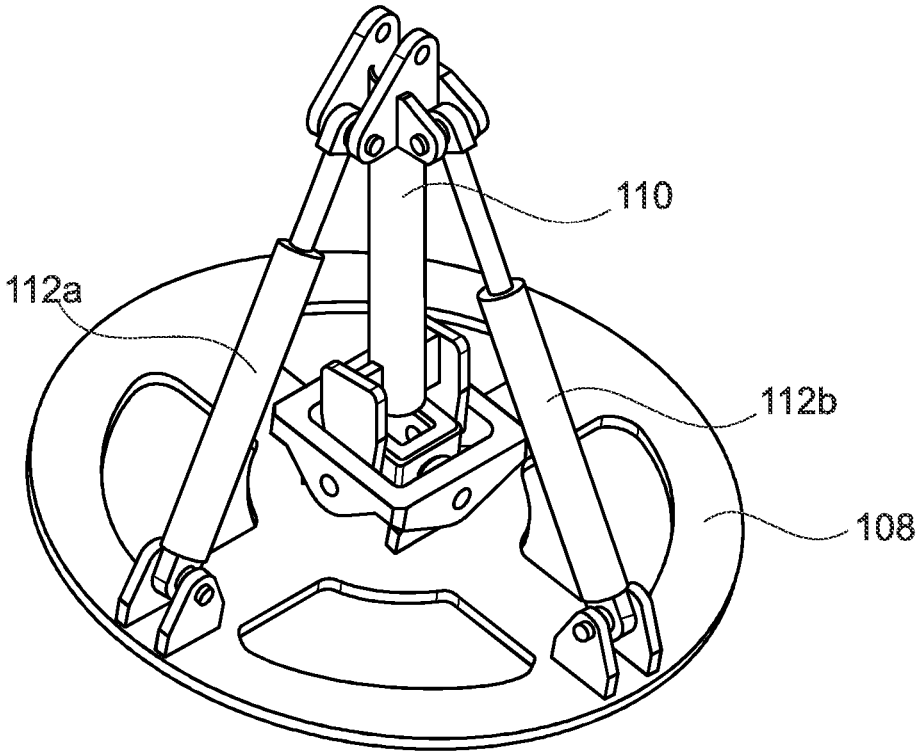
FIG. 6 is a perspective view of the load control apparatus of FIG. 1, when inclined in a single plane.
Figure 7:
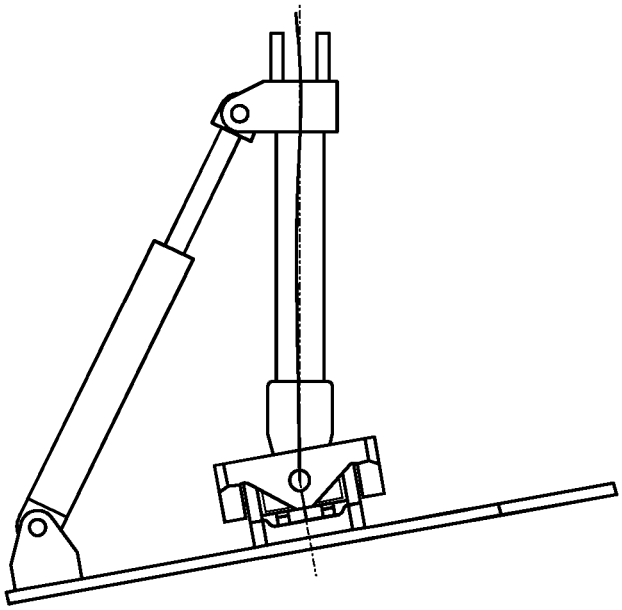
FIG. 7 is a side elevation view of the load control apparatus of FIG. 6.

FIGS. 6 and 7 illustrate the lift control apparatus 100 with one actuator 112*b* extended from a neutral position. In this example actuator 112*b* is in an extended position and is longer than actuator 112*a*, which is in a neutral position. The base 108 is therefore inclined in a single plane with respect to the support element 110. It will be appreciated that a similar inclination of the base 108 in the opposite direction can be achieved by contracting the actuator 112*b* compared to its neutral position.

Figure 8:
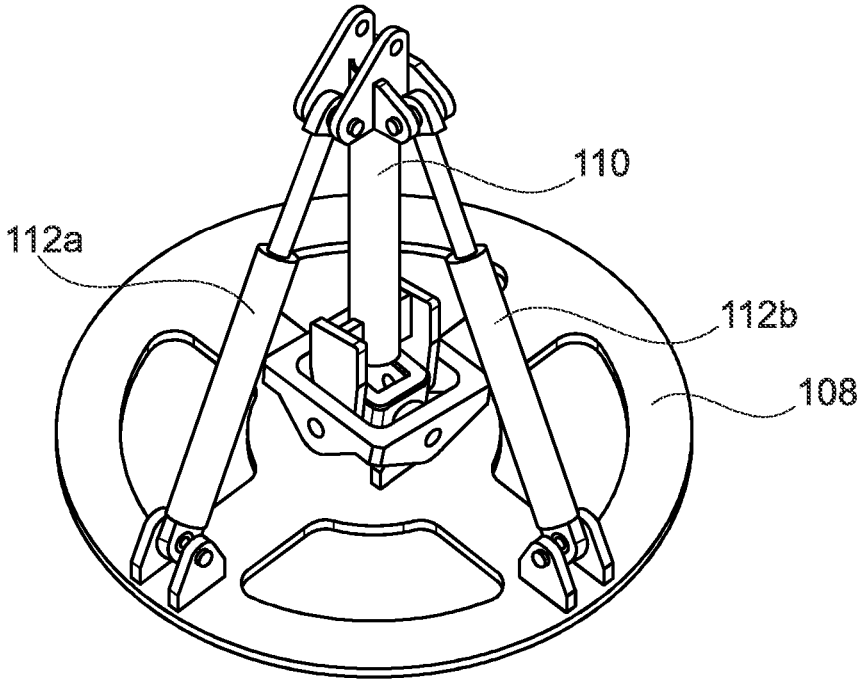
FIG. 8 is a perspective view of the load control apparatus of FIG. 1, when inclined in two planes.
Figure 9:
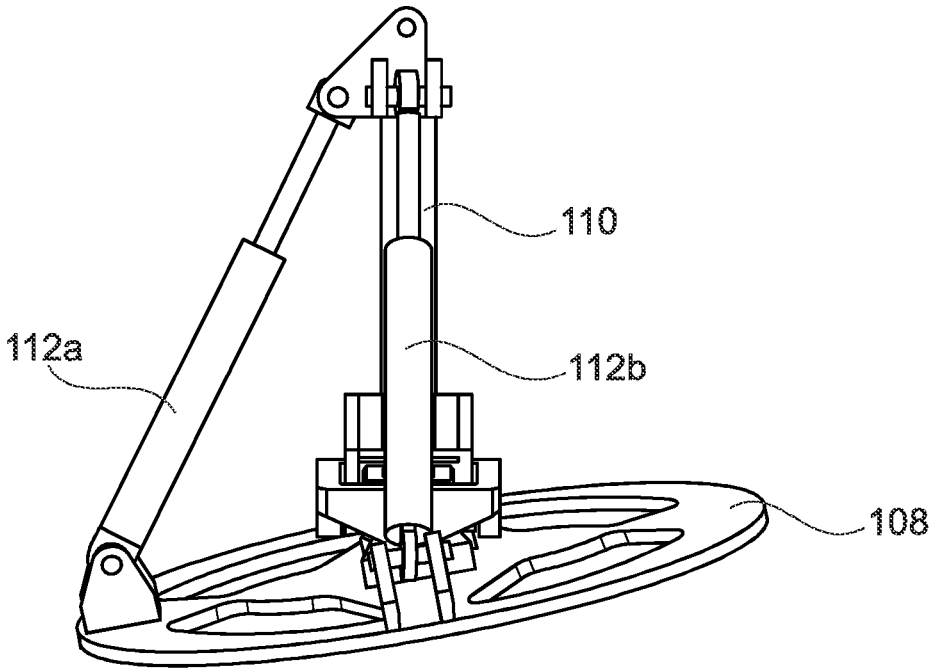
FIG. 9 is a side elevation view of the load control apparatus of FIG. 8.

FIGS. 8 and 9 illustrate the lift control apparatus 100 with both actuators 112 extended from a neutral position. In this example both actuators 112*a*, 112*b* are extended compared to the neutral position. The base 108 is therefore inclined in two planes with respect to the support element 110. Again, it will be appreciated that a similar inclination of the base 108 in the opposite direction can be achieved by contracting both of the actuators 112*a*, 112*b* compared to their neutral position.

In use, actuation of the actuator 112 causes the base 108 to pivot relative to the support element 110 (and lift line 104). In other words, the actuators 112 can extend and retract to apply a force to the support element 110 and the base 108. As an actuator is extended or retracted, the lift line 104 is deflected by the applied force at the connecting portion 116 to the support element 110, thereby acting against any motion of the lift load 106. In other words, the applied force acts to oppose the inertia of the lift load 106, and thereby reduce any oscillatory motion of the load 106.

Aptly the force applied by the actuators 112 is nominally less than the lift load and does not form part of the primary load path. This reduces the chances of the load 106 being directed in the opposite direction to the original motion by the actuators 112 and prevents the load control apparatus from causing further unwanted swinging motion.

For example, during lifting of the load 106, the load 106 may start to swing in a pendulum like motion. The controller can monitor the movement of the load 106, and in response to movement of the load 106, can operate the actuators 112. One or more of the actuators 112 can be extended or retracted to apply a pivoting force to the support element 110 and the base 108. This force opposes the inertia of the load 106 and therefore acts to decelerate and reduce the movement of the load.

Figure 10:
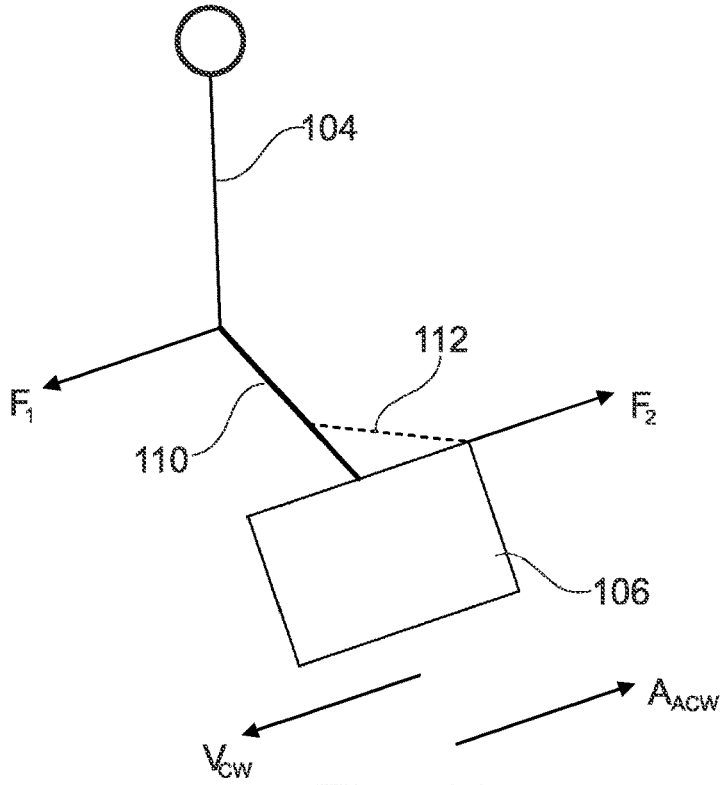
FIGS. 10 and 11 are schematics showing forces acting upon a lift line and a load.
Figure 11:
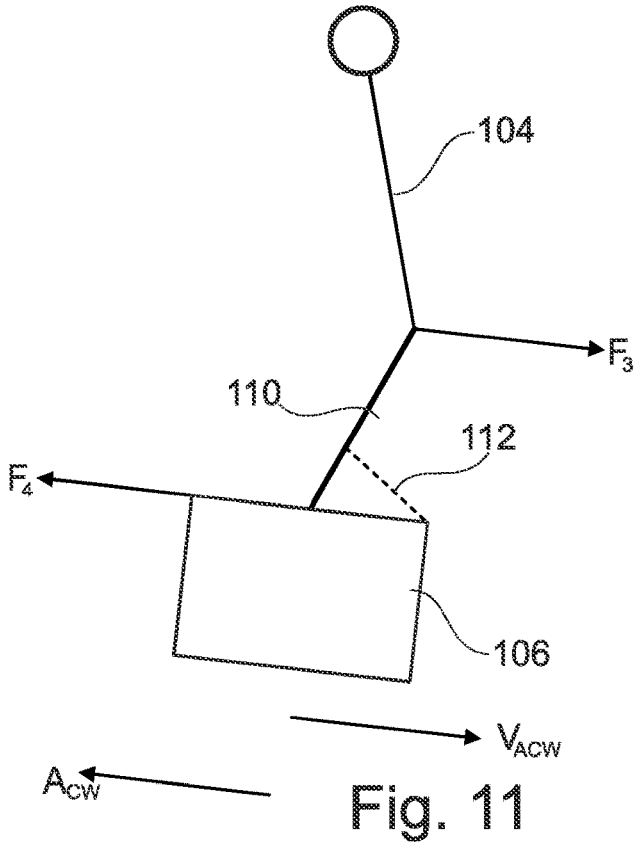

This operation is shown more clearly in FIGS. 10 and 11, which illustrate a simplified two dimensional version of the forces applied by the actuators 112.

FIG. 10 illustrates the forces applied by the actuators 112 when the load 106 is swinging in a clockwise direction on the page (velocity $V_{CW}$). As the load 106 swings in a clockwise direction the actuator 112 is extended from its neutral position. The actuator 112 therefore applies a force $F_1$ to the lift line 104, thereby deflecting the lift line to the left as shown in the Figure. I.e., the actuator deflects the lift line in the direction of movement of the load 106). An opposite force $F_2$ is consequently applied to the load to oppose the clockwise swing $V_{CW}$, thereby decelerating the load 106 as shown by $A_{ACW}$.

FIG. 11 illustrates the forces applied by the actuators 112 when the load 106 is swinging in an anticlockwise clockwise direction on the page (velocity $V_{ACW}$). As the load 106 swings in an anti-clockwise direction the actuator 112 is contracted from its neutral position. The actuator therefore applies a force $F_3$ to the lift line 104, thereby deflecting the lift line to the right as shown in the Figure. So, the actuator deflects the lift line in the direction of movement of the load 106). An opposite force $F_4$ is consequently applied to the load to oppose the anti-clockwise swing $V_{ACW}$, thereby decelerating the load 106 as shown by $A_{CW}$.

The actuators 112 can be continually controlled by the control unit to extend and contract to oppose movement of the load 106 as illustrated in FIGS. 10 and 11. Of course, when two or more actuators 112 are used, the swing movements of the load 106 can be controlled in all directions by extending and/or contracting the relevant actuator(s) 112 as required.

When landing a load 106 on a platform that is not moving relative to the lifting apparatus (e.g. moving a load from one position on land to another position on land), the load control apparatus 100 can be set to reduce any movement of the load 106 with respect to the lifting apparatus such that there is very little or no relative movement of the load with respect to the lifting apparatus as the load is placed in its landing position.

However, when landing on a platform that is moving relative to the lifting apparatus (e.g. moving a load from land to a deck on a vessel when the crane 102 is positioned on land), the relative movement of the landing platform or deck with respect to the load also should be considered. For example, a sensing means operatively connected to the control means on the lifting apparatus may be positioned on the landing platform to sense motion of the landing platform. The further sensing means may then transmit motion data to the control means on the lifting apparatus. The control means on the lifting apparatus can then use the relative values of displacement, velocity and acceleration to determine how to control the actuators to affect movement of the load appropriately with respect to the movement of the landing platform.

The load control apparatus 100 can be used with any existing crane 102 or lifting apparatus 102 since it can be attached directly to a crane hook or a lifting line 104. This has the additional advantage that the apparatus does not affect the load certification of the crane 102 because the crane 102 itself does not require any modification.

The load control apparatus is also much lighter that known damping systems and typically can weight around 70 kg, though of course the actual weight of the apparatus will depend on the lift load requirements. This means that using the load control apparatus will not significantly affect the load mass that a lifting device can hold.

In some embodiments, the lift control apparatus 100 may further include at least one compass or compass heading mounted on the lift control apparatus itself and/or on a landing platform to determine the relative orientations of the load with respect to the landing platform and allow for lift load rotation about the lift line axis.

In an alternative arrangement to the embodiment described above, the support element may include a tubular column or other hollow column structure. The lift line of the lifting apparatus can then extend through the tubular column and attach directly to the lift load. As such, when the lift line is connected to the load (e.g. via a hook), the tubular column can brace against the portion of the lift line that is received in the tubular column. The portion of lift line received in the tubular column is therefore effectively part of a rigid column structure and the apparatus can function in a similar manner to the above-described embodiment.

In an alternative arrangement to the embodiment described above, the base may form part of the load. That is, a base may be integrated into the load itself. This could be a similar base to the one described above having a plate, or the base could simply include portions of the load to which the support element and the actuators are or can be connected.

Although the embodiment above has been described having two actuators 112, it will be appreciated that one, three, four or more actuators 112 may be used. Aptly, the load control apparatus 100 includes at least two actuators to allow inclination of the support element 110 in all planes with respect to the base 108. Of course, three or four actuators may also be used and can work together to affect movement of the load.

For example, four actuators 112 may be equally spaced about the support element 110 and outer portion of the base 108. In this example as one actuator 112 extends, the actuator opposite would contract. This arrangement may be advantageous for particularly heavy loads as two actuators can act together to apply a force to the lift line and affect movement of the load.

Although the actuators have been described above as extending orthogonally with respect to each other from the support element, it will be appreciated that other angles may also be possible. For example, the actuators may extend only approximately orthogonally with respect to each other from the support element, or may extend at any other suitable angle with respect to each other from the support element.

It will be appreciated that the actuators 112 do not need to extend between the base 108 and the second end of the support element 110. Alternatively, the actuator 112 may extend between the base 106 and a position between the ends of the support element 110, which may be adjacent the second end. Alternatively, the actuator 112 may be connected to the support element 110 by a bracket that extends beyond the second end thereof. In this way, the actuators 112 can still operate to exert a force on the support element 110 and deflect the lift line to reduce the movement of the load 106.

Although the actuators have been described above as hydraulic rams, other actuators, for example pneumatic or electromechanical actuators, may also be used. Although the support element described above is a substantially cylindrical column, other suitable support elements may be in the form of a rod, post, pole, beam, or bar having any suitable shape, for example.

With the present invention, the centre of gravity of the load is changed against the oscillating movement of a swinging load. Thus, negative work (negative angular momentum) is added to the system. As the load swings, the actuator changes the centre of mass against the direction of swing, reducing the angular momentum.

With the present invention, a load control apparatus is provided that can actively respond to movement of a load and mitigate against the effects of a swinging motion. Also, the apparatus can respond to movement of a suspended load and apply a force to oppose the movement of the load.

Also, the load control apparatus may allow lifting apparatus in worse sea conditions compared to the conditions permissible for previously known lifting apparatus.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

It will be appreciated by those skilled in the art that several variations to the aforementioned embodiments are envisaged without departing from the scope of the invention. It will also be appreciated by those skilled in the art that any number of combinations of the aforementioned features and/or those shown in the appended drawings provide clear advantages over the prior art and are therefore within the scope of the invention described herein.

The invention claimed is:

1. A load control apparatus for controlling movement of a suspended load, the apparatus comprising:

a base for attachment to or forming part of a load;

a support element pivotally secured to and extending from the base for connecting to a lift line;

actuation means comprising two actuators connected to the support element and to the base at respective positions which are spaced from the pivotal connection between the support element and the base such that actuation, in use, of the actuation means causes the two actuators to apply a force to the support element and the base such that the base pivots relative to the support element;

wherein the two actuators extend at an angle with respect to each other from the support element such that actuation of each of the two actuators causes the base to pivot about a different axis; and a control means operable to control the actuation of the actuation means in response to movement of the supsended load.

2. A load control apparatus as claimed in claim 1, wherein the support element comprises a column pivotally connected to a central portion of the base at or adjacent a first end thereof, the actuation means being connected to the column at or adjacent a second end thereof and connected to an outer portion of the base.

3. A load control apparatus as claimed in claim 2, wherein the column comprises a connection means at or adjacent the second end for connecting to the lift line.

4. A load control apparatus as claimed in claim 3, wherein each of the two actuators is connected to the column at or adjacent the second end and to different outer portions of the base such that actuation, in use, of each actuator causes the base to pivot about a different axis relative to the column.

5. A load control apparatus as claimed in claim 2, wherein the column is configured to receive, in use, a portion of a lift line that is connected to the base or to the load.

6. A load control apparatus as claimed in claim 1, wherein the pivotal connection allows the support element to pivot about two or more axes relative to the base.

7. A load control apparatus as claimed in claim 1, wherein the pivotal connection between the base and the support element comprises a universal joint or a gimbal unit.

8. A load control apparatus as claimed in claim 1, wherein the base comprises a plate with a central portion to which the support element is pivotally connected and an outer portion to which the actuation means is connected.

9. A load control apparatus as claimed in claim 1, wherein the actuation means is pivotally connected to each of the support element and the base.

10. A load control apparatus as claimed in claim 1, wherein the actuation means comprises a hydraulic or pneumatic or electromechanical actuator.

11. A load control apparatus as claimed in claim 1, wherein the support element comprises connection means including one or more lifting holes for receiving a lifting element attached to a lifting line.

12. A load control apparatus as claimed in claim 1, wherein the base comprises one or more attachment features for attaching the base to the load.

13. A method of controlling movement of a load using the apparatus as described in claim 1, the method comprising applying via the actuation means a pivoting force between the support element and the base to oppose a movement of the suspended load.

* * * * *